United States Patent [19]

Naito et al.

[11] Patent Number: 4,732,120

[45] Date of Patent: Mar. 22, 1988

[54] CONTROL APPARATUS FOR INTERNAL COMBUSTION ENGINE PROVIDED WITH PERMANENT MAGNET TYPE STARTING MOTOR

[75] Inventors: Shotaro Naito, Katsuta; Taiji Hasegawa, Nakaminato, both of Japan

[73] Assignee: Hitachi, Ltd., Tokyo, Japan

[21] Appl. No.: 830,716

[22] Filed: Feb. 19, 1986

[30] Foreign Application Priority Data

Feb. 20, 1985 [JP] Japan ..... 60-30448

[51] Int. Cl.[4] ..... F02N 11/08

[52] U.S. Cl. ..... 123/179 B; 123/179 G

[58] Field of Search ..... 123/179 B, 179 G, 179 L; 290/38 R

[56] References Cited

U.S. PATENT DOCUMENTS

| | | | |
|---|---|---|---|
| 2,912,595 | 11/1959 | Kehm et al. | 123/179 B |
| 3,573,481 | 4/1971 | Cummins | 290/38 R |
| 3,668,411 | 6/1972 | Leger | 123/179 B |
| 3,847,130 | 11/1974 | Miyoshi et al. | 123/179 G |
| 4,415,812 | 11/1983 | Griffith et al. | 290/38 R |
| 4,436,073 | 3/1984 | Miyagi | 123/179 L |

FOREIGN PATENT DOCUMENTS

| | | | |
|---|---|---|---|
| 2344701 | 3/1975 | Fed. Rep. of Germany | 123/179 L |
| 3322209 | 1/1985 | Fed. Rep. of Germany . | |
| 2072382 | 9/1981 | United Kingdom . | |

*Primary Examiner*—Andrew M. Dolinar

*Attorney, Agent, or Firm*—Antonelli, Terry & Wands

[57] ABSTRACT

An internal combustion engine control apparatus in which an operation of a starting motor is detected so as to drive an engine start control device, the starting motor being provided with a permanent magnet as a field magnet, the control device being provided with a starting state detector having a function for distinguishing a voltage associated with an induced voltage owing to inertia-rotation of the starting motor from a voltage associated with application of a supply voltage so as not to detect the starting state of the engine when the starting motor is rotating by inertia.

6 Claims, 3 Drawing Figures

CONTROL APPARATUS FOR INTERNAL COMBUSTION ENGINE PROVIDED WITH PERMANENT MAGNET TYPE STARTING MOTOR

BACKGROUND OF THE INVENTION

The present invention generally relates to a control apparatus for an internal combustion engine of a vehicle, in which an operating state of a starting motor for starting the internal combustion engine is detected so as to actuate an internal combustion engine start control device to operate in starting of the engine, and particularly relates to an internal combustion engine control apparatus of the type described above provided with a starting motor having a permanent magnet as a field magnet.

In an internal combustion engine control apparatus provided with a permanent magnet type starting motor, which is known, for example, in Japanese Patent Unexamined Publication No. 55-46064, a start control device (for example, a starting fuel increasing device, or the like) actuated to operate in starting or cranking of the internal combustion engine is arranged to be actuated upon detection of a voltage applied to a solenoid coil of a magnet switch provided for driving/stopping the starting motor.

In such a case as described above where the magnetic field of the starting motor is provided by a permanent magnet, however, there has been a problem that an induced voltage generated in the starting motor even after turning-off of a key switch, may be applied to the solenoid coil of the magnet switch and this voltage applied to the coil of the magnet switch is detected as if the starting motor is operating.

This erroneous detection may actuate the start control device to operate at an undesired time. For example, in a start control device provided with fuel increasing means for increasing fuel in starting of the internal combustion engine, the fuel increasing operation is continued even after the starting motor has been stopped, resulting in such a problem that a failure in firing of the fuel may be caused or an exhaust gas becomes dirty too much because of the excessive fuel supply.

SUMMARY OF THE INVENTION

It is therefore an object of the present invention to solve the foregoing problems in the prior art.

It is another object of the present invention to provide an apparatus for controlling an internal combustion engine provided with a starting motor having a permanent magnet, as a field magnet, for starting the engine, which is capable of preventing the operating condition of the motor from being erroneously judged by a voltage induced in the motor after deenergizing the motor, thereby preventing a start control device from erroneously operating at an undesired time.

In order to attain the above objects, an apparatus of the present invention is provided with means for comparing a voltage at a junction point of three parts, that is, a key switch and series and shunt coils of a magnet switch, with a battery voltage and means for determining whether the motor is in a predetermined operating condition or not, or whether the motor is energized for starting the engine or not, based on an output of the comparator means, thereby preventing the operating condition of the motor from being erroneously judged by a voltage induced in the motor when the motor is still rotating by its inertia after deenergized.

In such an arrangement as described above, when the key switch is opened, the comparing means never produce its output signal even if the starting motor is rotated by inertia, and therefore the start control device is not actuated to operate.

The present invention will be apparent from the following detailed description taken in conjunction with the accompanying drawings.

DESCRIPTION OF THE PREFERRED EMBODIMENTS

Figure 1:
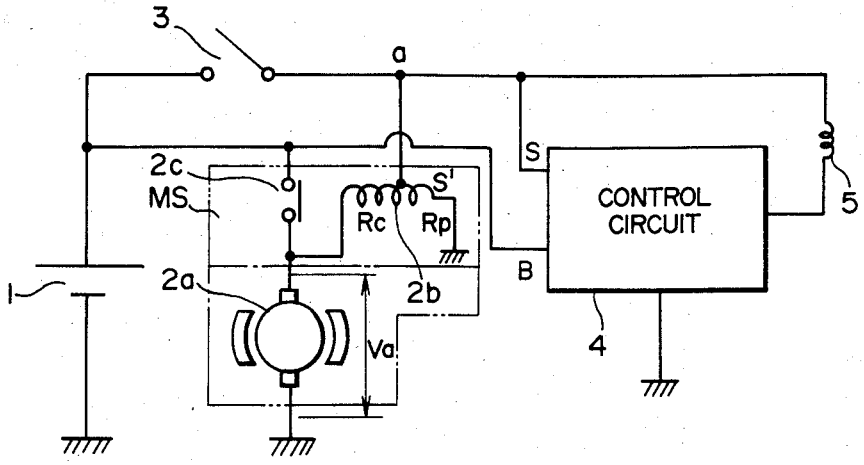
FIG. 1 is a block diagram showing the whole arrangement of an engine starting system to which a control apparatus according to the present invention is applied.
Figure 2:
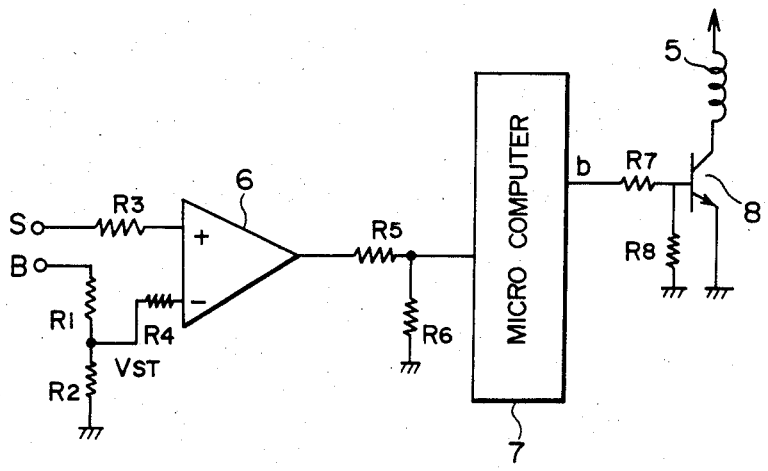
FIG. 2 is a block diagram showing an embodiment of a device for detecting the operation of the starting motor according to the present invention.

Referring to FIGS. 1 and 2, an embodiment according to the present invention will be described in detail.

When a key switch 3 is closed, a current is allowed to pass through a series coil $R_C$ of a solenoid coil 2*b* of a magnet switch MS and a starting motor 2*a* from a battery 1. Then, a normally open contact 2*c* of the magnet switch MS is closed by magnetomotive force generated in the series coil $R_C$, so that the starting motor 2*a* is energized by an electric power from the battery 1 through the contact 2*c*. When the starting motor 2*a* starts to drive an engine (not shown) and the key switch 3 is opened, the contact 2*c* of the magnet switch MS is still held at its closed state by magnetomotive force of a shunt coil $R_P$ of the coil 2*b* energized by an induced voltage of the motor which is still rotating by inertia.

A control circuit 4 has an input terminal B to which a voltage $V_B$ of the battery 1 is applied and another input terminal S to which a voltage $V_S$ at a junction a between the key switch 3 and the coil 2*b* is applied.

In FIG. 2 showing the control circuit 4 in detail, there are provided a comparator 6 and a series circuit of resistors $R_1$ and $R_2$ connected between the input terminal B and the earth. The voltage $V_S$ received at the input terminal S is applied to a positive terminal of the comparator 6 through a resistor $R_3$, while the voltage $V_B$ applied to the input terminal B is divided by the series connection of the resistors $R_1$ and $R_2$ to obtain a reference voltage $V_{ST}$ which is applied to a negative terminal of the comparator 6 through a resistor $R_4$.

The output of the comparator 6 is applied, after divided by a series connection of resistors $R_5$ and $R_6$, to a microcomputer 7.

The microcomputer 7 makes a judgement as to whether the starting motor 2*a* is actively driven for rotation or rotated by inertia on the basis of the output of the comparator 6, or whether the engine is in its cranking state or not. If it is decided that the engine is in its cranking state, a controlling output is generated at an output terminal b of the microcomputer 7, and applied to the base of a transistor 8 after divided by a series connection of resistors $R_7$ and $R_8$. So long as the output of the microcomputer 7 is generated at its output terminal b, the transistor 8 is kept conductive so as to supply a current to a solenoid 5 for opening a valve (not shown) used to increase fuel. In brief, the valve for increasing fuel is opened by the solenoid 5 so as to increase the fuel supply to the engine while the engine is in its cranking state.

Now, description will be made of the way how to detect the state of operation of the starting motor 2a.

Figure 3:
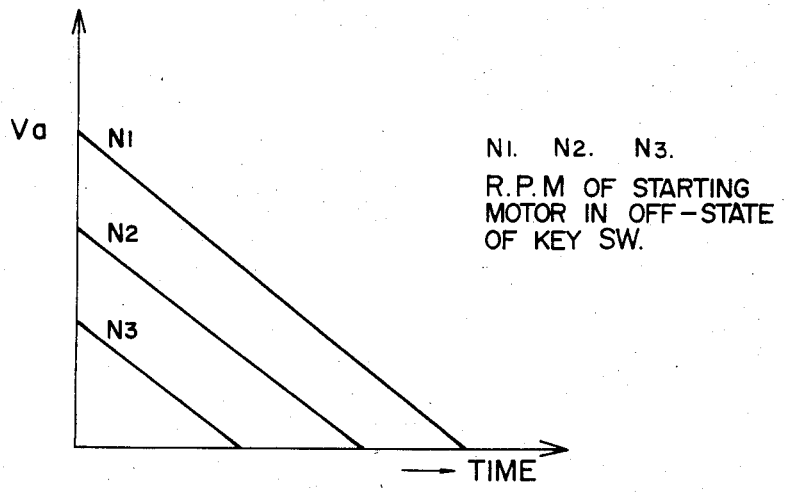
FIG. 3 is a diagram showing time-variation of an induced voltage generated in the permanent magnet type starting motor when rotating by inertia after the key switch is opened at different numbers of revolutions per minute of the same.

The input voltage $V_S$ applied to the input terminal S after the key switch 3 has been opened is obtained by the following expression:

$$V_S = \frac{R_{\gamma P}}{R_{\gamma C} + R_{\gamma P}} \times V_a \quad (1)$$

where $R_{\gamma P}$ represents a resistance value of the shunt coil $R_P$; $R_{\gamma C}$ represents a resistance value of the series coil $R_C$; and $V_a$ represents an induced voltage which is generated in the starting motor 2a due to rotation-by-inertia thereof after the motor is deenergized. The induced voltage decreases at a certain rate which varies depending on the number of revolutions per minute N1–N3 at which the motor 2a was driven just before deenergized, as shown in FIG. 3.

Here, the induced voltage $V_a$ is not larger than the voltage $V_B$ (that is, $V_a \leqq V_B$), and therefore the voltage $V_S$ is necessarily smaller than $V_B$ (that is, $V_S < V_B$).

On the other hand, when the key switch 3 is in its closed state, the input voltage $V_S$ is equal to or substantially equal to $V_B$, and therefore when the starting motor 2a is in its operating state, the input voltage $V_S$ takes a value substantially equal to the voltage $V_B$.

On the other hand, the reference voltage $V_{ST}$ applied to the negative input of the comparator 6 can be expressed as follows:

$$V_{ST} = V_B \times \frac{R_2}{R_1 + R_2} \quad (2)$$

Accordingly, if the respective resistance values $R_1$, $R_2$, $R_{\gamma P}$, and $R_{\gamma C}$ are selected to satisfy the following relationships (3), $$1 > \frac{R_2}{R_1 + R_2} > \frac{R_{\gamma P}}{R_{\gamma C} + R_{\gamma P}} \quad (3)$$

the input voltages $V_S$ and $V_{ST}$ applied to the comparator 6 satisfies the relationship $$V_S \approx V_B > V_{ST}$$

when the key switch 3 is in its closed state and the motor 2a is therefore energized for rotation, so that the output of the comparator 6 becomes high in its level.

When the key switch 3 is opened, on the contrary, even if the induced voltage $V_a$ is generated by the inertia-rotation of the motor 2a, the input voltage $V_S$ is necessarily smaller than the voltage $V_{ST}$ so as to make the output of the comparator low because $$V_B > V_S, \text{ and } \frac{R_2}{R_1 + R_2} > \frac{R_{\gamma P}}{R_{\gamma C} + R_{\gamma P}}.$$

Accordingly, if the output level of the comparator 6 is supervised by the microcomputer 7, the judgement can be clearly made as to whether the permanent magnet type starting motor 2a is being rotated owing to the turning-on of the key switch 3 or not, that is, as to whether the engine is in its cranking state or not. In addition to the embodiment as described above, the start control device may include a suction air increasing device, an ignition timing control device, etc.

What is claimed:

1. An apparatus for controlling an internal combustion engine provided with a permanent magnet-type starting motor comprising:

a magnet switch having a switch contact connected between a power source and said starting motor and coil means including series and shunt coils for actuating said contact, a first electric circuit for supplying an electric current from said power source to said starting motor through a key switch and said series coil, a second electric circuit connecting a junction between said key switch and said series coil to said shunt coil for supplying an electric current from said power source through said key switch to said shunt coil, start controlling means for controlling a given operation of said engine when said starting motor is actuated to rotate for starting the engine, comparator means for comparing a voltage at said junction with a predetermined reference voltage thereby determining whether said starting motor is in a predetermined operating condition or not, said predetermined reference voltage being a voltage lower than a source voltage of said power source and higher than any voltage appearing at said junction between said key switch and said series coil when said starting motor rotates by inertia as said key switch is opened, and means for actuating said starting controlling means upon detecting that said motor is in the predetermined operating condition.

2. An apparatus according to claim 1, wherein said starting controlling means is a fuel increasing device operating to increase fuel supply to the engine when the engine is started.

3. An apparatus for controlling an internal combustion engine provided with a permanent-type starting motor which is selectively energized by an electric power supplied from an electric power source for starting the engine comprising:

means for providing a circuit point which provides a first electrical voltage relating to a voltage of said electrical power source when said motor is energized, and provides a second electrical voltage relating to a voltage induced in said motor when said motor is deenergized, means for generating a predetermined reference voltage having a value selected to be lower than said first electrical voltage and higher than an expected maximum voltage level of said second electrical voltage, means for comparing an electrical voltage appearing at said circuit point with said predetermined reference voltage, means for determining whether said motor is in a predetermined operating condition or not based on an output of said comparing means, and means actuated when said determining means determines that said motor is in the predetermined operating condition for effecting a given operation in starting of said engine.

4. An apparatus according to claim 3, wherein said given operation effecting means is a fuel increasing device for increasing fuel supply to the engine when said engine is started.

5. An apparatus for controlling a given operation of an internal combustion engine comprising:

a starting motor having a permanent magnet for providing a magnetic field, a key switch selectively closed for starting said engine, a magnet switch having a normally opened contact and coil means connected through said key switch to an electrical power source an including series and shunt coils operative when energized to close said contact, said coil means being energized by an electric power from said power source when said key switch is closed, an electric circuit connecting said motor through said contact to said power source so that said motor is energized to rotate by an electric power from said power source when said contact is closed, a microcomputer for comparing a voltage at a junction between said coil means and said key switch with a predetermined reference voltage thereby, producing an output when a predetermined relationship exists between said junction voltage and said reference voltage, said predetermined reference voltage being a voltage lower than a source voltage of said power source and higher than any voltage appearing at said junction between said coil means and said key switch when said motor is rotated by inertia as said key switch is opened, and start control means responsive to said output of said microcomputer to effect a given operation in starting of said engine.

6. An apparatus according to claim 5, wherein said start control means is a fuel increasing device for increasing fuel supply to said engine in starting thereof.

* * * * *